United States Patent [19]

Tarver

[11] Patent Number: 4,659,520

[45] Date of Patent: Apr. 21, 1987

[54] AIR INJECTOR

[76] Inventor: Stephen C. Tarver, P.O. Box 127, Gillette, Wyo. 82716

[21] Appl. No.: 831,176

[22] Filed: Feb. 20, 1986

[51] Int. Cl.[4] ..... B01F 3/04

[52] U.S. Cl. ..... 261/25; 261/82

[58] Field of Search ..... 261/25, 82; 137/114; 261/30, 26

[56] References Cited

U.S. PATENT DOCUMENTS

| | | | |
|---|---|---|---|
| 417,664 | 12/1889 | Chichester | 261/30 |
| 980,447 | 1/1911 | Smith | 261/25 |
| 2,359,991 | 10/1944 | Hinsch | 137/114 |
| 2,604,310 | 7/1952 | Brown | 261/82 |
| 3,226,099 | 12/1965 | Black et al. | 261/82 |
| 3,381,699 | 5/1968 | Coffman | 137/114 |
| 3,412,741 | 11/1968 | Mills | 261/26 |
| 3,646,960 | 3/1972 | Jidling et al. | 261/30 |
| 3,763,878 | 10/1973 | Harden | 137/114 |

FOREIGN PATENT DOCUMENTS

| | | | |
|---|---|---|---|
| 19207 | of 1909 | United Kingdom | 261/82 |

*Primary Examiner*—Tim Miles

[57] ABSTRACT

This is a device for injecting air into a water supply under pressure in a closed system. One embodiment consists of two sliding pistons inside a closed housing. The two pistons are connected to each other by a connecting rod. They are positioned so that they slide alternately toward one end of said housing and then toward the other end. They are propelled first in one direction and then the other by water entering under pressure alternately through two openings, one on each side of the driving piston and exiting alternately through two other openings on opposite sides of said driving piston. These valves are opened and closed alternately in pairs by a means driven by the movement of said pistons. The second piston, driven by the first, draws air into said housing as it moves in the other direction.

2 Claims, 2 Drawing Figures

AIR INJECTOR

One way to remove iron and rust from water for household use is to inject air into the water supply under pressure as it comes from the source and then run the water through a screen to break the air bubbles into a multitude of microscopic bubbles. The oxygen in these bubbles combines with the iron in the water and turns it into tiny particles of rust which can then be filtered out of the water by running it through a filter containing appropriate filtering material.

The present invention, when installed in the incoming water line, provides a simple and effective method of injecting the air into the water to provide the necessary oxygen for the above-described iron removal process.

This invention is quite similar to the invention described in Ser. No. 822,630, filed Jan. 27, 1986, which was a continuation-in-part of Ser. No. 712,970, now abandoned. There is one major difference, however, which gives this invention a significant advantage over the one just referred to.

In that air injector the water pressure under which the water leaves the air injector varies considerably from the beginning of one air injection cycle to the beginning of the next. With the invention which is the subject of this application, the pressure under which the water leaves the air injector varies only slightly.

Figure 1:
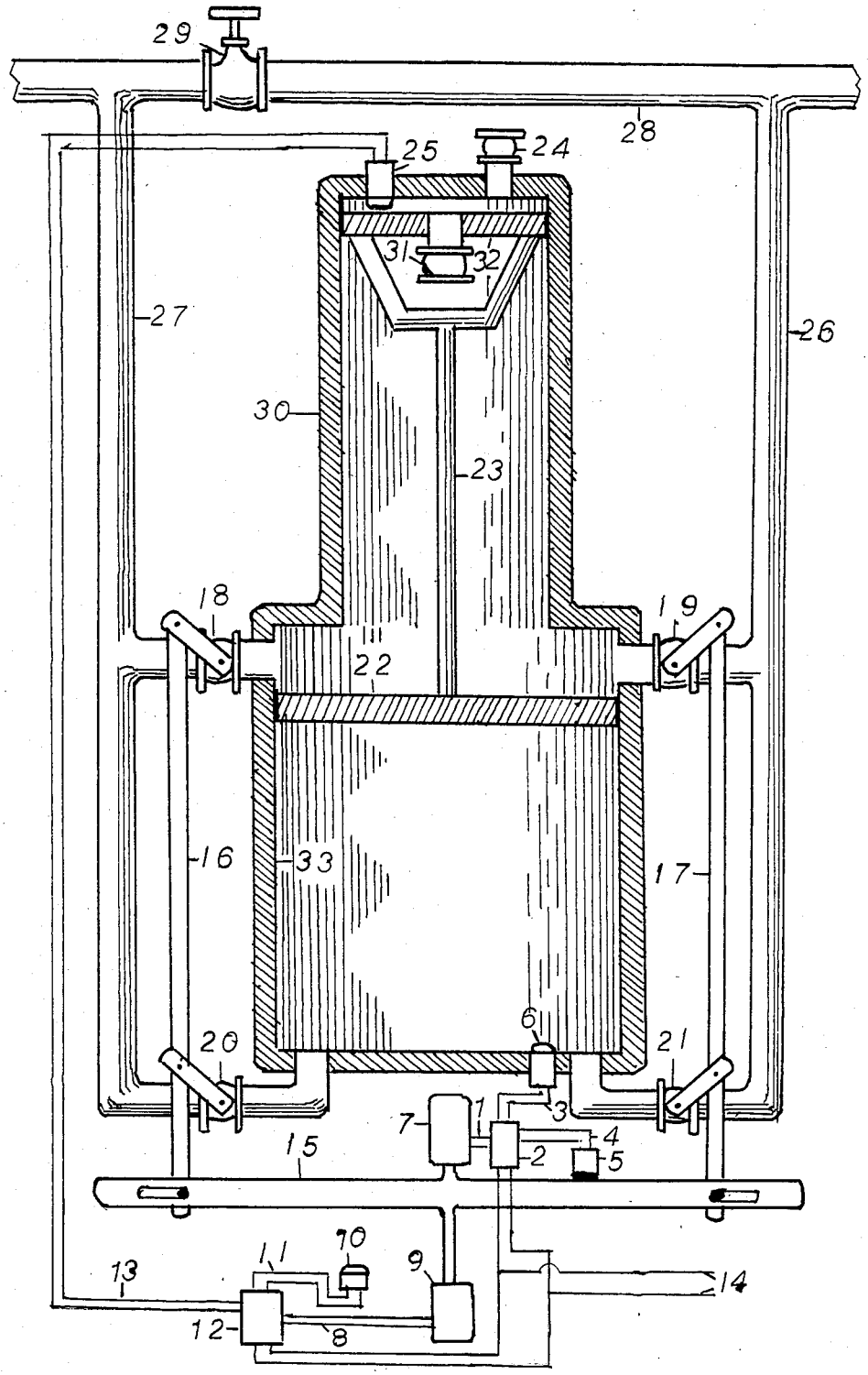
FIG. 1: Embodiment of invention in which air is mixed with the water inside the housing.

As shown in the accompanying drawing FIG. 1, it consists of a closed chamber, cylindrical in shape, with one end section 33 substantially larger than the other end section 30. The water under pressure enters alternately through valve 18 and valve 20 and leaves alternately through valve 19 and valve 21.

When valve rods 16 & 17 are in the position shown in FIG. 1, valves 20 and 19 are open and valves 18 and 21 are closed. Thus when an outlet valves to which pipe 26 is opened, water entering valve 20 under pressure causes piston 22 to move toward valve 19. This causes piston 32 to actuate waterproof push-button switch 25 closing circuit 13 and actuating holding relay switch 12. This actuates solenoid 9 pulling crosspiece 15 toward it and in turn pulling valve rods 16 & 17. This causes valve 18 and valve 21 to open and it causes valve 19 and valve 20 to close.

The water then entering through valve 18 under pressure forces piston 22 toward valve 21 forcing the water beneath piston 22 out through valve 21 and outlet pipe 26 to the open outlet valve connected to pipe 26.

This causes piston 32 to be pulled away from the end of housing section 30 thereby causing a vacuum in the space above piston 32. This vacuum then fills with air to atmospheric pressure through check valve 24.

When piston 22 reaches the end of housing section 33 and thereby actuates waterproof push-button 6 it closes circuit 3. This actuates holding relay switch 2 causing it to actuate solenoid 7. This pulls crosspiece 15 back into the position as shown in FIG. 1. This in turn again closes valve 18 and 21 and opens valves 20 and 19 causing piston 22 and 32 to return again to the position as shown in FIG. 1.

When piston 32 thus moves toward check valve 24 the air drawn in on the previous down stroke is compressed above piston 32 but can escape through check valve 31 into the chamber below piston 32.

When piston 22 again actuates push-button switch 6 which in turn actuates solenoid 7 opening valve 19, the air trapped below piston 32 on the previous upward stroke will then leave the air injector together with the water leaving through that valves. Thus the air injection process will be accomplished.

Relay switches 2 and 12 are holding relays to insure that solenoids 7 and 9 remain energized until valves which they operate are either completely open or completely closed. Push-button switches 5 and 10 are positioned to open the holding circuits 4 and 11 when crosspiece 15 engage those when the valves referred to above are either completely open or completely closed.

Circuit 14 represents lead wires to the power source.

Pipe 28 provides a by-pass for any water not needed to move piston 22. Valve 29 provides a means of regulating the amount of air injected into the water by controlling the amount of water being bypassed through pipe 28.

Figure 2:
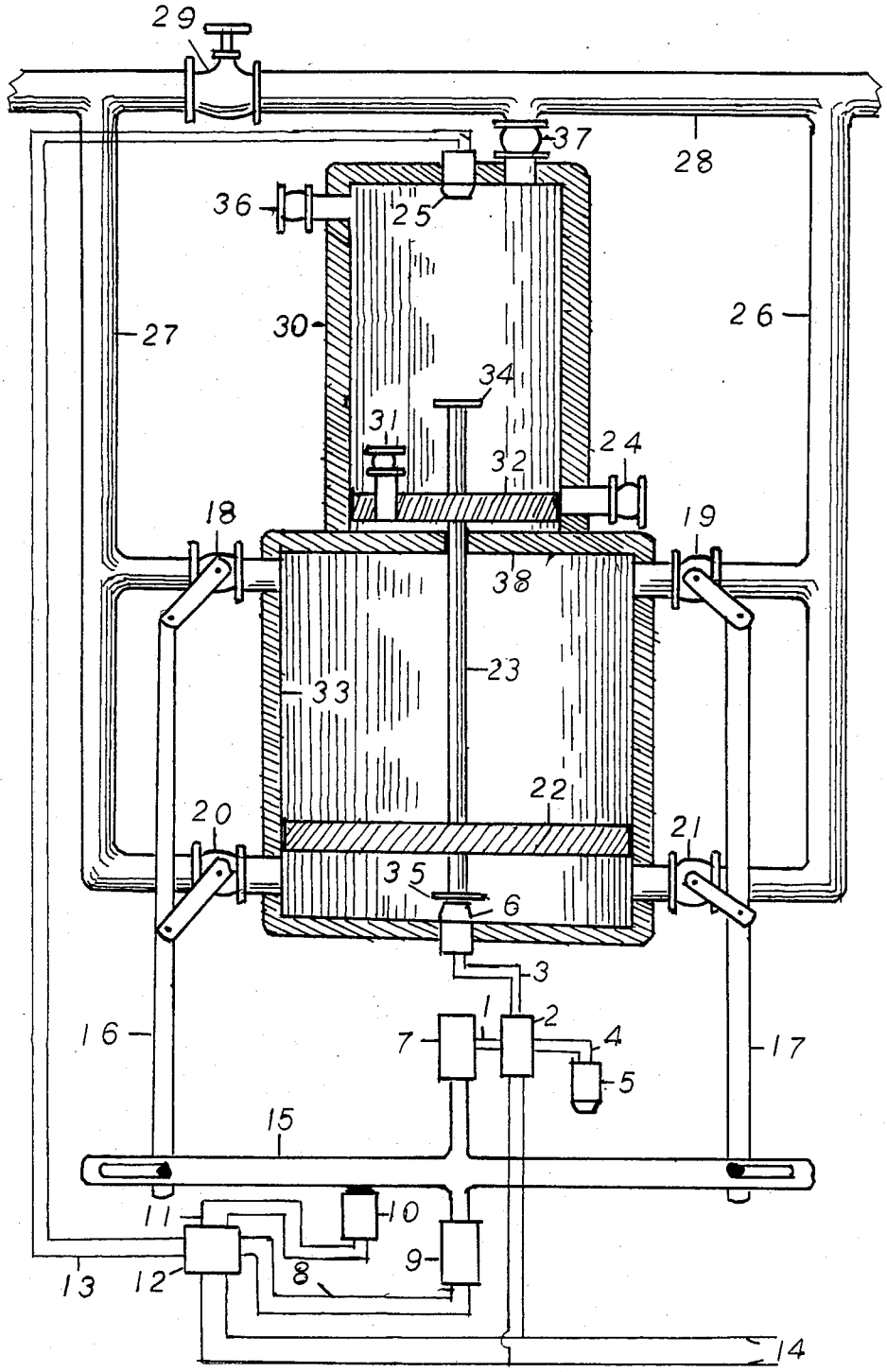
FIG. 2: Embodiment of invention in which air is mixed with the water after leaving the housing.

In the embodiment shown in FIG. 2 the valve closing mechanism and the electrical circuits work in exactly the same way as in the embodiment shown in FIG. 1.

Dividing wall 38 results in the air being forced directly into and mixed with the water in pipe 28 rather than inside the housing as occurs in the embodiment shown in FIG. 1.

The embodiment in FIG. 2 shows four check valves above dividing wall 38. However only two of them would be required to make the air injector function.

By eliminating valve 36 and 37 and leaving valves 31 and 24, the air would be drawn into housing section 30 on the upward stroke of piston 32. On the next downward stroke this air would be allowed to escape into the part of housing section 30 above check valve 31. Then on the next upward stroke of piston 32 this air would be forced into pipe 28 through the pipe in which check valve 37 would otherwise be located.

By eliminating valves 31 and 24 instead of valves 36 & 37, air would be drawn into the upper housing section 30 on the downward stroke of piston 32 through check valve 36. On the next upward stroke of piston 32 the air would be forced into pipe 28 through check valve 37 thus completing the air injection function.

I claim:

1. A device to inject air into water under pressure comprising: An enclosed elongated housing around two pistons connected to each other by a connecting rod, and positioned to slide alternately toward one end of said housing and then toward the other, said pistons being propelled back and forth by water under pressure entering alternately through two openings, one on each side of the driving piston, and alternately exiting through two openings on the opposite sides of said driving, and further including a means to alternately open and close said openings in pairs, said means being activated by movement of said pistons, and also a check valve mounted in the other piston to allow air to pass through it in one direction but not the other and further including a check valve mounted in said housing to allow air to enter said housing above said other piston from the outside.

2. A device to inject air into water under pressure comprising: An enclosed elongated housing around two pistons connected to each other by a connecting rod, and positioned to slide alternately toward one end of said housing and then toward the other, said pistons being propelled back and forth by water under pressure entering alternately through two openings, one on each side of the driving piston, and alternately exiting through two openings on the opposite sides of said driving piston, and further including a means to alternately open and close said openings in pairs, said means being activated by movement of said pistons, and also including a check valve in said housing to allow air to enter above said other piston from the outside and another check valve to allow air to leave said housing from above said other piston.

* * * * *